US011840387B2

(12) United States Patent
Thompson

(10) Patent No.: US 11,840,387 B2
(45) Date of Patent: Dec. 12, 2023

(54) CARRIER FOR CONTAINERS

(71) Applicant: Graphic Packaging International, LLC, Atlanta, GA (US)

(72) Inventor: Jon Thompson, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/835,127

(22) Filed: Jun. 8, 2022

(65) Prior Publication Data

US 2022/0396407 A1 Dec. 15, 2022

Related U.S. Application Data

(60) Provisional application No. 63/208,568, filed on Jun. 9, 2021.

(51) Int. Cl.
*B65D 71/48* (2006.01)
*B65B 17/02* (2006.01)

(52) U.S. Cl.
CPC ..... *B65D 71/48* (2013.01); *B65B 17/025* (2013.01); *B65D 2571/0066* (2013.01); *B65D 2571/00141* (2013.01); *B65D 2571/00265* (2013.01); *B65D 2571/00444* (2013.01); *B65D 2571/00524* (2013.01); *B65D 2571/00716* (2013.01)

(58) Field of Classification Search
CPC ..... B65D 71/00; B65D 71/40; B65D 71/42; B65D 71/44; B65D 71/48; B65D 75/00; B65D 2571/00141; B65D 2571/00265; B65D 2571/00444; B65D 2571/00524; B65D 2571/0066; B65D 2571/00716
USPC ..... 206/141, 148, 153, 158; 294/87.2
See application file for complete search history.

(56) References Cited

U.S. PATENT DOCUMENTS

| | | | |
|---|---|---|---|
| 1,527,399 | A | 2/1925 | Davidson |
| 2,289,859 | A | 7/1942 | Arthur |
| 2,320,440 | A | 6/1943 | Kruea |
| 2,331,038 | A | 10/1943 | Meller |
| 2,397,376 | A | 3/1946 | Caldwell |
| 2,397,716 | A | 4/1946 | Wendler |
| 2,522,950 | A | 9/1950 | Keith |
| 2,594,376 | A | 4/1952 | Arneson |
| 2,594,377 | A | 4/1952 | Arneson |
| 2,737,326 | A | 3/1956 | Toensmeier |

(Continued)

FOREIGN PATENT DOCUMENTS

| | | |
|---|---|---|
| AT | 399701 B | 7/1995 |
| CA | 2133827 | 10/1993 |

(Continued)

OTHER PUBLICATIONS

International Search Report and Written Opinion for PCT/US2022/032608 dated Sep. 28, 2022.

(Continued)

*Primary Examiner* — Bryon P Gehman
(74) *Attorney, Agent, or Firm* — WOMBLE BOND DICKINSON (US) LLP

(57) ABSTRACT

A carrier for holding a plurality of containers includes a front portion having a front attachment panel for at least partially receiving a respective container of the plurality of containers, a back portion having a back attachment panel for at least partially receiving a respective container of the plurality of containers, and a reinforcement portion extending from the front portion to the back portion for reinforcing the carrier.

36 Claims, 4 Drawing Sheets

(56) References Cited

U.S. PATENT DOCUMENTS

| | | | |
|---|---|---|---|
| 2,798,603 | A | 7/1957 | Grinspoon |
| 2,814,385 | A | 11/1957 | Stone |
| 2,950,041 | A | 8/1960 | Stone |
| 2,965,410 | A | 12/1960 | Hughes |
| 3,001,647 | A | 9/1961 | Liss |
| 3,005,654 | A | 10/1961 | Stone et al. |
| 3,046,711 | A | 7/1962 | Harrison |
| 3,061,141 | A | 10/1962 | Cote |
| 3,094,210 | A | 6/1963 | Van Der Berg |
| 3,099,475 | A | 7/1963 | Manizza |
| 3,118,537 | A | 1/1964 | Copping |
| 3,128,034 | A | 4/1964 | Weiss |
| 3,137,109 | A | 6/1964 | Rapata |
| 3,146,885 | A | 9/1964 | Grantham |
| 3,156,358 | A | 11/1964 | Randrup |
| 3,200,944 | A | 8/1965 | Rapata |
| 3,223,308 | A | 12/1965 | Weiss |
| 3,245,711 | A | 4/1966 | Dantoin |
| 3,257,066 | A | 6/1966 | Williams |
| 3,281,180 | A | 10/1966 | Spery |
| 3,302,784 | A | 2/1967 | Copping |
| 3,387,879 | A | 6/1968 | Wood |
| 3,404,912 | A | 10/1968 | Watts |
| 3,410,596 | A | 11/1968 | Slevin, Jr. |
| 3,432,202 | A | 3/1969 | Ebelhardt |
| 3,463,535 | A | 8/1969 | Beart |
| 3,528,697 | A | 9/1970 | Wood |
| 3,587,847 | A | 6/1971 | Graser |
| 3,601,439 | A | 8/1971 | Poupitch |
| 3,612,266 | A | 10/1971 | Graser |
| D222,579 | S | 11/1971 | Oglesbee |
| 3,627,121 | A | 12/1971 | Deasy |
| 3,653,503 | A | 4/1972 | Arneson |
| 3,693,787 | A | 9/1972 | Duerr |
| 3,698,550 | A | 10/1972 | Graser |
| 3,701,416 | A | 10/1972 | Lawrence |
| 3,722,945 | A | 3/1973 | Wood |
| 3,726,558 | A | 4/1973 | Klygis |
| 3,734,278 | A | 5/1973 | Kerrigan |
| 3,876,066 | A | 4/1975 | Klygis |
| 3,897,873 | A | 8/1975 | Graser |
| 3,924,739 | A | 12/1975 | Gravesteijn |
| 3,942,631 | A | 3/1976 | Sutherland et al. |
| 4,029,204 | A | 6/1977 | Manizza |
| 4,111,298 | A | 9/1978 | Mascia |
| 4,120,396 | A | 10/1978 | Mascia |
| 4,136,772 | A | 1/1979 | Mascia |
| 4,155,502 | A | 5/1979 | Forte |
| 4,190,149 | A | 2/1980 | Oliff et al. |
| 4,192,540 | A | 3/1980 | Oliff |
| D257,001 | S | 9/1980 | Oliff |
| 4,244,617 | A | 1/1981 | Manizza |
| 4,304,329 | A | 12/1981 | Graser |
| D265,292 | S | 7/1982 | Killy |
| 4,339,032 | A | 7/1982 | Wood |
| D265,979 | S | 8/1982 | Arfert |
| 4,372,599 | A | 2/1983 | Kiedaisch et al. |
| 4,378,879 | A | 4/1983 | Killy |
| 4,382,505 | A | 5/1983 | Sutherland et al. |
| 4,441,611 | A | 4/1984 | Sommariva |
| 4,453,630 | A | 6/1984 | Helms |
| 4,471,870 | A | 9/1984 | Uhlig |
| 4,523,676 | A | 6/1985 | Barrash |
| D294,331 | S | 2/1988 | Panazzolo |
| 4,736,977 | A | 4/1988 | Killy |
| 4,784,266 | A | 11/1988 | Chaussadas |
| D304,017 | S | 10/1989 | Oliff |
| 4,911,288 | A | 3/1990 | Dantoin, Jr. |
| 4,974,726 | A | 12/1990 | Klygis et al. |
| 5,002,225 | A | 3/1991 | Bienaime |
| 5,065,862 | A | 11/1991 | Mousseau |
| 5,103,971 | A | 4/1992 | Schuster |
| 5,125,506 | A | 6/1992 | Galbierz et al. |
| 5,135,104 | A | 8/1992 | Jorba |
| 5,139,147 | A | 8/1992 | Sutherland |
| D329,807 | S | 9/1992 | Heider |
| 5,188,225 | A | 2/1993 | Jorba |
| 5,193,673 | A | 3/1993 | Rathbone et al. |
| 5,201,412 | A | 4/1993 | Schuster et al. |
| 5,230,425 | A | 7/1993 | Edqvist et al. |
| 5,246,113 | A | 9/1993 | Schuster |
| 5,263,299 | A | 11/1993 | Galbierz et al. |
| 5,267,644 | A | 12/1993 | Tsao |
| 5,282,348 | A | 2/1994 | Dampier et al. |
| 5,297,673 | A | 3/1994 | Sutherland |
| 5,310,050 | A | 5/1994 | Sutherland |
| 5,310,051 | A | 5/1994 | Sutherland |
| 5,314,224 | A | 5/1994 | Bates |
| 5,318,178 | A | 6/1994 | Davies et al. |
| 5,323,895 | A | 6/1994 | Sutherland et al. |
| 5,328,024 | A | 7/1994 | Sutherland |
| 5,335,774 | A | 8/1994 | Ganz |
| 5,351,815 | A | 10/1994 | Fogle et al. |
| 5,351,816 | A | 10/1994 | Sutherland et al. |
| 5,351,817 | A | 10/1994 | Sutherland |
| 5,355,999 | A | 10/1994 | Sutherland |
| 5,360,104 | A | 11/1994 | Sutherland |
| 5,390,784 | A | 2/1995 | Sutherland |
| 5,407,065 | A | 4/1995 | Sutherland |
| 5,415,278 | A | 5/1995 | Sutherland |
| 5,425,446 | A | 6/1995 | Weaver |
| 5,443,153 | A | 8/1995 | Sutherland |
| 5,445,262 | A | 8/1995 | Sutherland |
| 5,452,799 | A | 9/1995 | Sutherland |
| 5,484,053 | A | 1/1996 | Harris |
| 5,485,914 | A | 1/1996 | Martin |
| 5,487,464 | A | 1/1996 | Galbierz et al. |
| 5,490,593 | A | 2/1996 | Gordon et al. |
| 5,503,267 | A | 4/1996 | Sutherland |
| 5,520,283 | A | 5/1996 | Sutherland |
| 5,524,756 | A | 6/1996 | Sutherland |
| 5,551,566 | A | 9/1996 | Sutherland |
| 5,553,704 | A | 9/1996 | Gordon et al. |
| 5,553,705 | A | 9/1996 | Bakx |
| 5,573,111 | A | 11/1996 | Gordon |
| 5,590,776 | A | 1/1997 | Galbierz |
| 5,593,027 | A | 1/1997 | Sutherland |
| 5,609,247 | A | 3/1997 | Appleton |
| 5,609,251 | A | 3/1997 | Harris |
| 5,609,379 | A | 3/1997 | Harrelson |
| 5,639,137 | A | 6/1997 | Bakx |
| 5,682,982 | A | 11/1997 | Stonehouse |
| 5,706,936 | A | 1/1998 | Bernstein |
| 5,711,419 | A | 1/1998 | Beales et al. |
| 5,735,394 | A | 4/1998 | Harrelson |
| 5,746,310 | A | 5/1998 | Slomski |
| 5,762,193 | A | 6/1998 | Marco |
| 5,791,463 | A | 8/1998 | Negelen |
| 5,816,391 | A | 10/1998 | Harris |
| 5,845,776 | A | 12/1998 | Galbierz et al. |
| 5,878,876 | A | 3/1999 | Galbierz et al. |
| 5,960,945 | A | 10/1999 | Sutherland |
| 6,039,181 | A | 3/2000 | Whiteside |
| 6,059,099 | A | 5/2000 | Galbierz |
| 6,082,532 | A | 7/2000 | Miess |
| 6,145,656 | A | 11/2000 | Marco |
| 6,293,392 | B1 | 9/2001 | Galbierz |
| 6,315,111 | B1 | 11/2001 | Sutherland |
| 6,394,272 | B1 | 5/2002 | Domansky |
| 6,896,130 | B2 | 5/2005 | Theelen |
| D506,925 | S | 7/2005 | Plumer |
| 7,011,209 | B2 | 3/2006 | Sutherland et al. |
| 7,690,507 | B2 | 4/2010 | Sutherland |
| 7,721,878 | B2 | 5/2010 | Requena |
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 8,056,709 | B2 | 11/2011 | Sutherland |
| 8,096,413 | B2 | 1/2012 | DePaula |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |

(56) References Cited

U.S. PATENT DOCUMENTS

| | | | |
|---|---|---|---|
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |
| 8,955,674 | B2 | 2/2015 | Spivey, Sr. et al. |
| 9,079,699 | B2 | 7/2015 | Holley, Jr. |
| 9,169,050 | B2 | 10/2015 | Spivey, Sr. |
| 9,284,090 | B2 | 3/2016 | Lettre |
| 9,359,093 | B2 | 6/2016 | DePaula et al. |
| 9,376,250 | B2 | 6/2016 | Spivey, Sr. |
| D767,408 | S | 9/2016 | Shuster |
| 9,446,891 | B2 | 9/2016 | Jones et al. |
| 9,511,916 | B2 | 12/2016 | Holley, Jr. |
| 9,669,976 | B2 | 6/2017 | Kastanek et al. |
| 9,676,535 | B2 | 6/2017 | Spivey, Sr. |
| 10,077,131 | B2 | 9/2018 | Lettre |
| D881,021 | S | 4/2020 | Bandinu |
| D881,718 | S | 4/2020 | Bandinu |
| 10,836,550 | B2 | 11/2020 | Zacherle |
| D918,057 | S | 5/2021 | L'Heureux |
| D918,058 | S | 5/2021 | L'Heureux |
| 11,014,727 | B2 | 5/2021 | McCree |
| D920,809 | S | 6/2021 | Chesnet et al. |
| D921,493 | S | 6/2021 | Chesnet |
| D923,416 | S | 6/2021 | Luciano |
| 11,027,905 | B2 | 6/2021 | Ford |
| 11,180,301 | B2 | 11/2021 | Smalley |
| D944,656 | S | 3/2022 | Spivey, Sr. |
| D946,416 | S | 3/2022 | Smalley |
| D946,417 | S | 3/2022 | Gonzalez Manzano |
| D946,418 | S | 3/2022 | Gonzalez Manzano |
| D946,419 | S | 3/2022 | Gonzalez Manzano |
| D946,420 | S | 3/2022 | Gonzalez Manzano |
| D946,421 | S | 3/2022 | Gonzalez Manzano |
| 11,261,013 | B2 | 3/2022 | Smalley |
| 11,286,094 | B2 | 3/2022 | Gonzalez Manzano |
| D955,889 | S | 6/2022 | Gonzalez Manzano |
| D955,890 | S | 6/2022 | Gonzalez Manzano |
| D956,574 | S | 7/2022 | Gonzalez Manzano |
| 11,401,095 | B2 | 8/2022 | Rosenbrien |
| 11,420,802 | B2 | 8/2022 | Kooc |
| D962,789 | S | 9/2022 | Noel |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0206639 | A1 | 10/2004 | Karlsson |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2006/0255114 | A1 | 11/2006 | Hand et al. |
| 2007/0080084 | A1 | 4/2007 | Sutherland |
| 2007/0163908 | A1 | 7/2007 | Sutherland |
| 2008/0257763 | A1 | 10/2008 | Ogg |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2011/0000799 | A1 | 1/2011 | Gonzalez |
| 2012/0080328 | A1 | 4/2012 | DePaula |
| 2012/0138489 | A1 | 6/2012 | Holley, Jr. |
| 2015/0191287 | A1 | 7/2015 | L'Heureux et al. |
| 2016/0325899 | A1 | 11/2016 | L'Heureux et al. |
| 2018/0111734 | A1 | 4/2018 | Jego |
| 2018/0222650 | A1 | 8/2018 | Zacherle |
| 2018/0362234 | A1 | 12/2018 | L'Heureux et al. |
| 2019/0119019 | A1 | 4/2019 | Patton |
| 2020/0010255 | A1 | 1/2020 | Zacherle et al. |
| 2020/0079564 | A1 | 3/2020 | Ford |
| 2020/0189817 | A1 | 6/2020 | Smalley |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |
| 2022/0097941 | A1 | 3/2022 | McCree |

FOREIGN PATENT DOCUMENTS

| | | | |
|---|---|---|---|
| DE | 298 13 672 | U1 | 11/1998 |
| DE | 203 19 247 | U1 | 5/2004 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 1 340 691 | A1 | 9/2003 |
| EP | 1 401 727 | B1 | 6/2006 |
| EP | 1 910 187 | B1 | 3/2009 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| FR | 2 737 196 | A1 | 1/1997 |
| GB | 1 256 684 | | 12/1971 |
| GB | 2 221 666 | A | 2/1990 |
| GB | 2 321 229 | A | 7/1998 |
| GB | 9006736716 | | 8/2019 |
| GB | 2591535 | A | 8/2021 |
| GB | 6161591 | | 9/2021 |
| JP | 10-194330 | A | 7/1998 |
| JP | 10-297668 | A | 11/1998 |
| JP | 11-193059 | | 7/1999 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| WO | WO 91/05716 | A1 | 5/1991 |
| WO | WO 93/02941 | | 2/1993 |
| WO | WO 93/02941 | A1 | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 95/10459 | A1 | 4/1995 |
| WO | WO 95/22495 | A1 | 8/1995 |
| WO | WO 96/26128 | A1 | 8/1996 |
| WO | WO 96/32340 | A1 | 10/1996 |
| WO | WO 03/016167 | A1 | 2/2003 |
| WO | WO 2006/044583 | A2 | 4/2006 |
| WO | WO 2008/058294 | A1 | 5/2008 |
| WO | WO 2010/006629 | A1 | 1/2010 |
| WO | WO 2010/101852 | A1 | 9/2010 |
| WO | WO 2016/112145 | A1 | 7/2016 |
| WO | WO 2020/210562 | A1 | 10/2020 |
| WO | WO 2021/038516 | A1 | 3/2021 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

International Search Report and Written Opinion for PCT/US2022/035207 dated Oct. 14, 2022.

(56) References Cited

OTHER PUBLICATIONS

International Search Report and Written Opinion for PCT/US2022/034840 dated Oct. 21, 2022.
International Search Report and Written Opinion for PCT/US2022/036297 dated Oct. 21, 2022.
International Search Report and Written Opinion for PCT/US2022/037069 dated Oct. 28, 2022.
International Search Report and Written Opinion for PCT/US2022/037071 dated Nov. 2, 2022.
International Search Report and Written Opinion for PCT/US2022/038638 dated Nov. 8, 2022.
"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/ florida-saltwater-brewery-non-plastic-six-pack-rings-spare-sea-turtles/ (Year: 2018).
"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).
Enviroclip. Date posted: 2022. Site visited: Sep. 12, 2022. Available online: https://www.graphicpkg.com/products/enviroclip/ (Year: 2022).
"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).
"The 'Ecogrip' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).
Cap-it packaging video on Vimeo. Date posted: 2021. Site visited: Sep. 19, 2022. Available online: https://vimeo.com/610619455?embedded=true&source=vimeo_logo&owner=24551687 (Year: 2021).
2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).

CARRIER FOR CONTAINERS

CROSS-REFERENCE TO RELATED APPLICATION

This application claims the benefit of U. S. Provisional Patent Application No. 63/208,568, filed on Jun. 9, 2021.

INCORPORATION BY REFERENCE

The disclosures of each of US. Provisional Patent Application No. 63/208,568, filed on Jun. 9, 2021, and U.S. Design Patent Application No. 29/838,182, filed on May 11, 2022, are hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a front portion comprising a front attachment panel for at least partially receiving a respective container of the plurality of containers, a back portion comprising a back attachment panel for at least partially receiving a respective container of the plurality of containers, and a reinforcement portion extending from the front portion to the back portion for reinforcing the carrier.

According to another aspect, the disclosure is generally directed to a blank for forming a carrier for holding a plurality of containers, the blank comprising a front portion comprising a front attachment panel for at least partially receiving a respective container of the plurality of containers, a back portion comprising a back attachment panel for at least partially receiving a respective container of the plurality of containers, and a reinforcement portion extending from the front portion to the back portion for reinforcing the carrier formed from the blank.

According to another aspect, the disclosure is generally directed to a method of forming a carrier for holding a plurality of containers, the method comprising obtaining a blank comprising a front portion, a back portion, and a reinforcement portion extending from the front portion of the blank to the back portion of the blank, the front portion comprising a front attachment panel and the back portion comprising a back attachment panel, the reinforcement portion comprising a reinforcement panel. The method further comprises positioning the front attachment panel for at least partially receiving a respective container of the plurality of containers to form a front portion of the carrier and positioning the back attachment panel for at least partially receiving a respective container of the plurality of containers to form a back portion of the carrier, and positioning the reinforcement panel extending from the front portion of the carrier to the back portion of the carrier to reinforce the carrier.

According to another aspect, the disclosure is generally directed to a package, the package comprising a plurality of containers and a carrier. The carrier comprises a front portion comprising a front attachment panel at least partially receiving a respective container of the plurality of containers, a back portion comprising a back attachment panel at least partially receiving a respective container of the plurality of containers, and a reinforcement portion extending from the front portion to the back portion for reinforcing the package.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
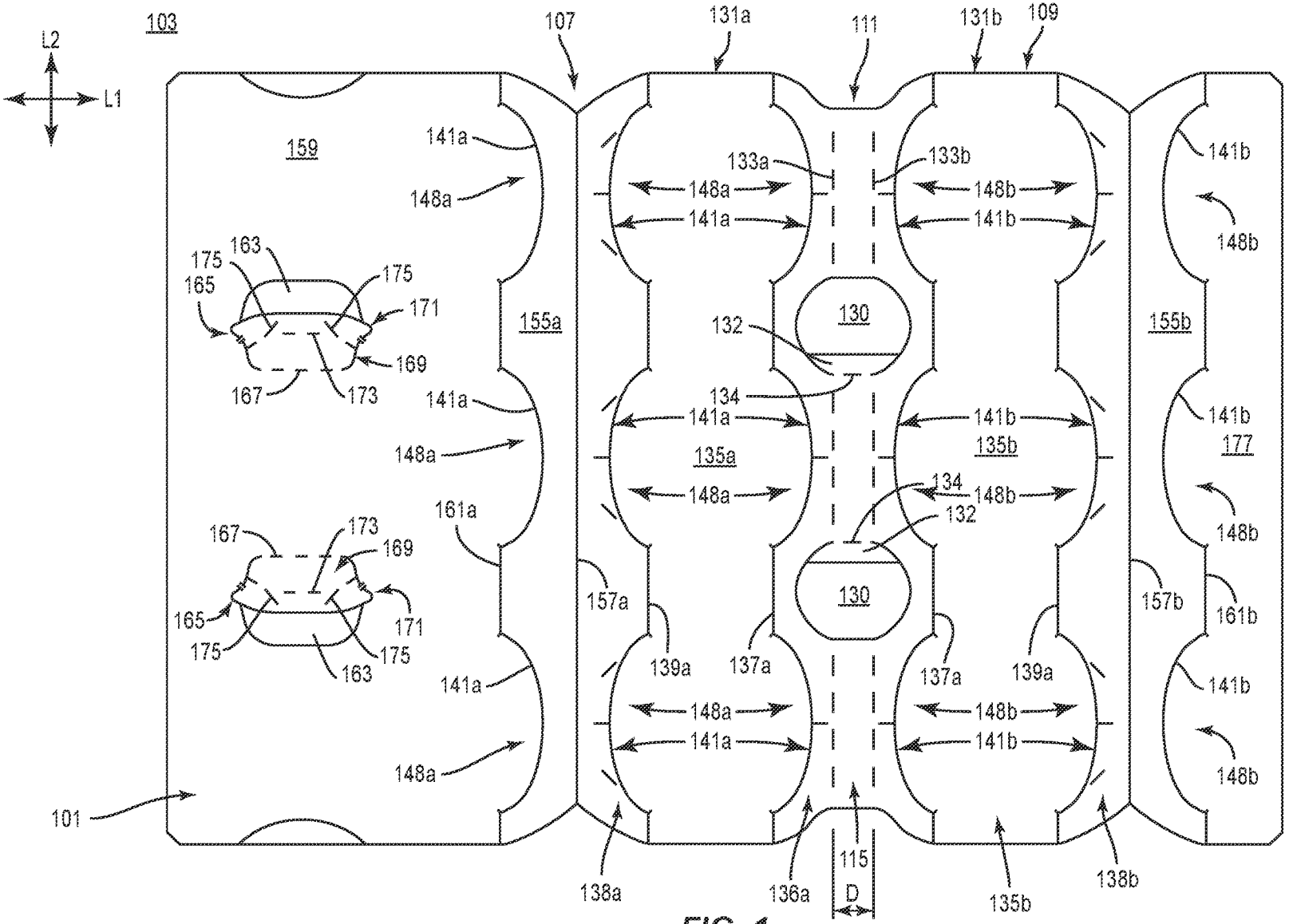
FIG. 1 is a plan view of an outer surface of a blank for forming a package and carrier according to an exemplary embodiment of the disclosure.
Figure 3:
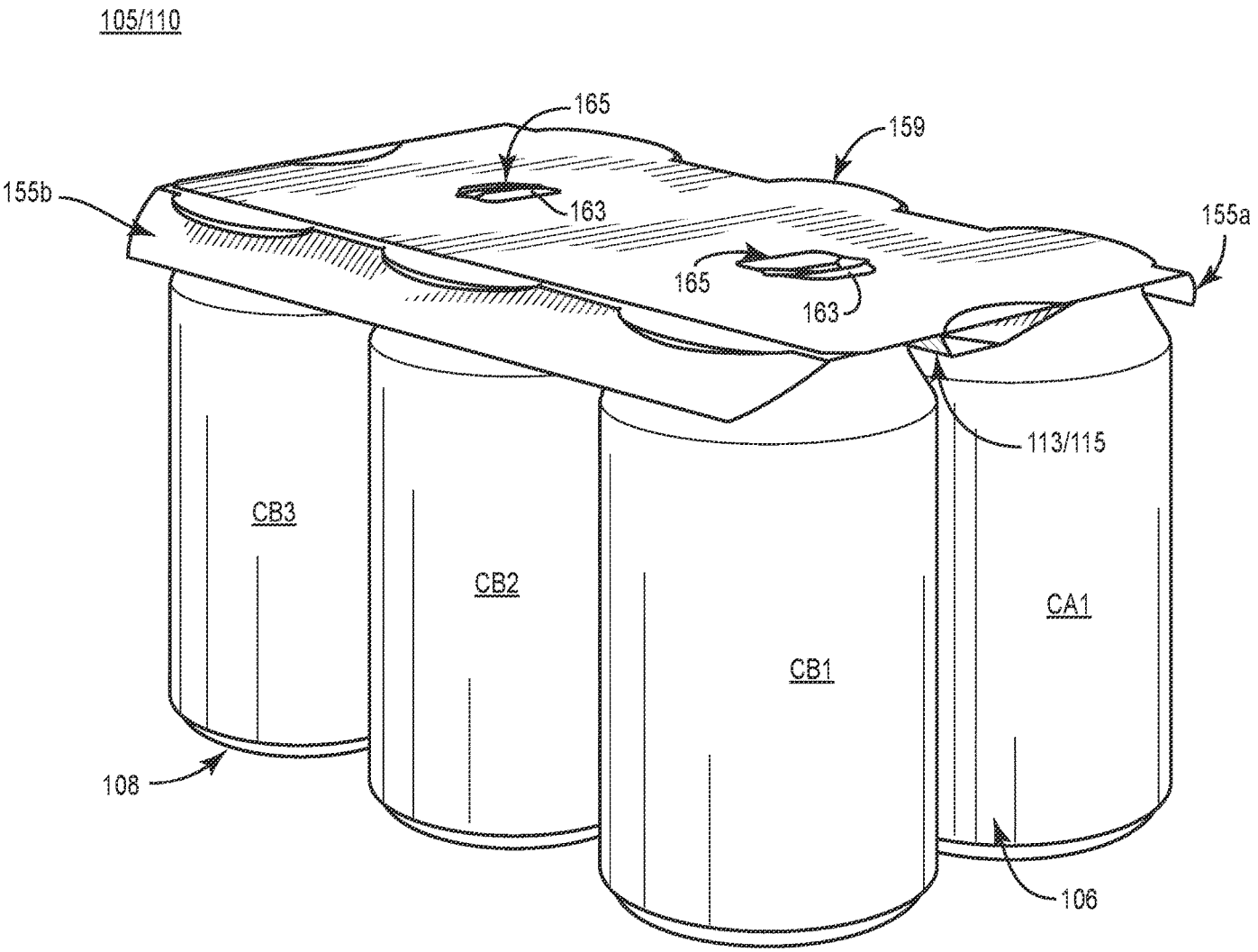
FIG. 3 is a perspective view of the package and carrier formed from the blank of FIG. 1 according to the exemplary embodiment.

FIG. 1 shows a plan view of an exterior side 101 of a blank 103 used to form a carrier 105 (FIG. 3) in accordance with a first exemplary embodiment of the disclosure. As shown in FIG. 3, the carrier 105 is sized to contain or support six containers, with three containers CA1, CA2, CA3 being attached to a front portion 106 of the carrier 105 and three containers CB1, CB2, CB3 being attached to a back portion 108 of the carrier 105. In the illustrated embodiment, the containers CA1, CA2, CA3, CB1, CB2, CB3 can be beverage cans, or could be any other suitable type and size of container without departing from the disclosure. In some embodiments, the containers can have an upper rim or other top portion corresponding to a diameter of 53 mm, 58 mm, or 56 mm, or the like.

The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure. The carrier 105 can be provided together with one or more containers as a package 110 (FIG. 3).

As shown in FIG. 1, the blank 103 has a longitudinal axis L1 and a lateral axis L2. The blank 103 has a front portion 107 for forming the front portion 106 of the carrier 105, a back portion 109 for forming the back portion 108 of the carrier 105, and a central or reinforcement portion 111 for forming a central or reinforcement portion 113 of the carrier 105.

In the illustrated embodiment, the reinforcement portion 111 of the blank 103 includes a reinforcement panel 115 interrupted by a laterally-spaced pair of handle apertures 130. The reinforcement panel 115 can have a width D along the longitudinal axis L1 defined between a pair of fold lines 133*a*, 133*b* to which the front portion 107 of the blank 103 and the back portion 109 of the blank 103 are foldably connected to the reinforcement portion 111, respectively.

While the reinforcement panel 115 is described in the illustrated embodiment as a single interrupted panel, it will be understood that such portion of the blank 103/carrier 105 can be formed from multiple cooperating panels/flaps/structures. The reinforcement portion 111 of the blank 103/reinforcement portion 113 of the carrier 105 can have a different configuration without departing from the disclosure. Furthermore, it will be understood that the reinforcement portion 111 of the blank 103/reinforcement portion 113 of the carrier 105 can be considered a central portion of the blank 103/carrier 105 and/or a portion of one of the front portion 107 of the blank 103/front portion 106 of the carrier 105 and the back portion 109 of the blank 103/back portion 108 of the carrier 105.

With continued reference to FIG. 1, the front portion 107 of the blank 103 can include a front container retention panel or front attachment panel 131*a* foldably connected to the reinforcement panel 115 at respective portions of a lateral fold line 133*a* that is interrupted by the handle apertures 130. As shown, handle reinforcement flaps 132 (broadly, "lower handle reinforcement flaps") can be foldably connected to the reinforcement panel 115 at respective longitudinal fold lines 134, and can be positioned to extend into the respective handle apertures 130.

The front attachment panel 131*a* can also include a container retention portion 135*a* that is at least partially defined between a pair of longitudinally-spaced lateral fold lines 137*a*, 139*a* that are each interrupted by a respective pair of longitudinally-spaced cuts 141*a* that can each include one or more curved and/or angled portions. As shown, the longitudinally-spaced cuts 141*a* define container retention tabs 148*a* that extend outwardly from the container retention portion 135*a*. As also shown, respective oblique cuts can extend outwardly from one or more cuts 141*a* that interrupt the fold line 139*a*. Furthermore, longitudinal cuts can extend outwardly from respective central portions of the cuts 141*a*.

As shown, an interior marginal portion 136*a* of the attachment panel 131*a* is defined between the fold lines 137*a*, 133*a*, and an exterior marginal portion 138*a* of the attachment panel 131*a* is defined between the fold line 139*a* and a lateral fold line 157*a* adjacent the attachment panel 131*a*.

A bevel or front side panel 155*a*, as shown, is foldably connected to the front attachment panel 131*a* at the lateral fold line 157*a*, and a front top panel 159 is foldably connected to the front side panel 155*a* at a lateral fold line 161*a*. The lateral fold line 157*a* can be interrupted by a plurality of the cuts 141*a* so as to define container retention tabs 148*a* protruding from the top panel 159, as described further herein.

The top panel 159, as shown, includes a pair of laterally-spaced handle openings 163 (broadly, "upper handle openings") that are generally aligned with the respective handle apertures 130 (broadly, "lower handle openings"). A respective handle reinforcement flap 165 (broadly, "upper handle reinforcement flap") can be foldably connected to the top panel 159 at respective longitudinal fold lines 167 and positioned to extend into the respective handle openings 163. Each handle reinforcement flap 165, as shown, can include a base portion 169 foldably connected to the top panel 159 at the respective fold lines 167, and a respective distal portion 171 foldably connected to the respective base portion 169 at a respective longitudinal fold line 173 and including a pair of oblique lines of weakening 175 intersecting the respective longitudinal fold lines 173.

In the illustrated embodiment, the back portion 109 of the blank 103 includes a back container retention panel or back attachment panel 131*b* and a back side panel 155*b* having associated features that are generally a mirror-image of the corresponding portions of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103.

The back portion 109 of the blank 103 also includes a second top panel or attachment flap 177 foldably connected to the back side panel 155*b* at a lateral fold line 161*b*.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 2:
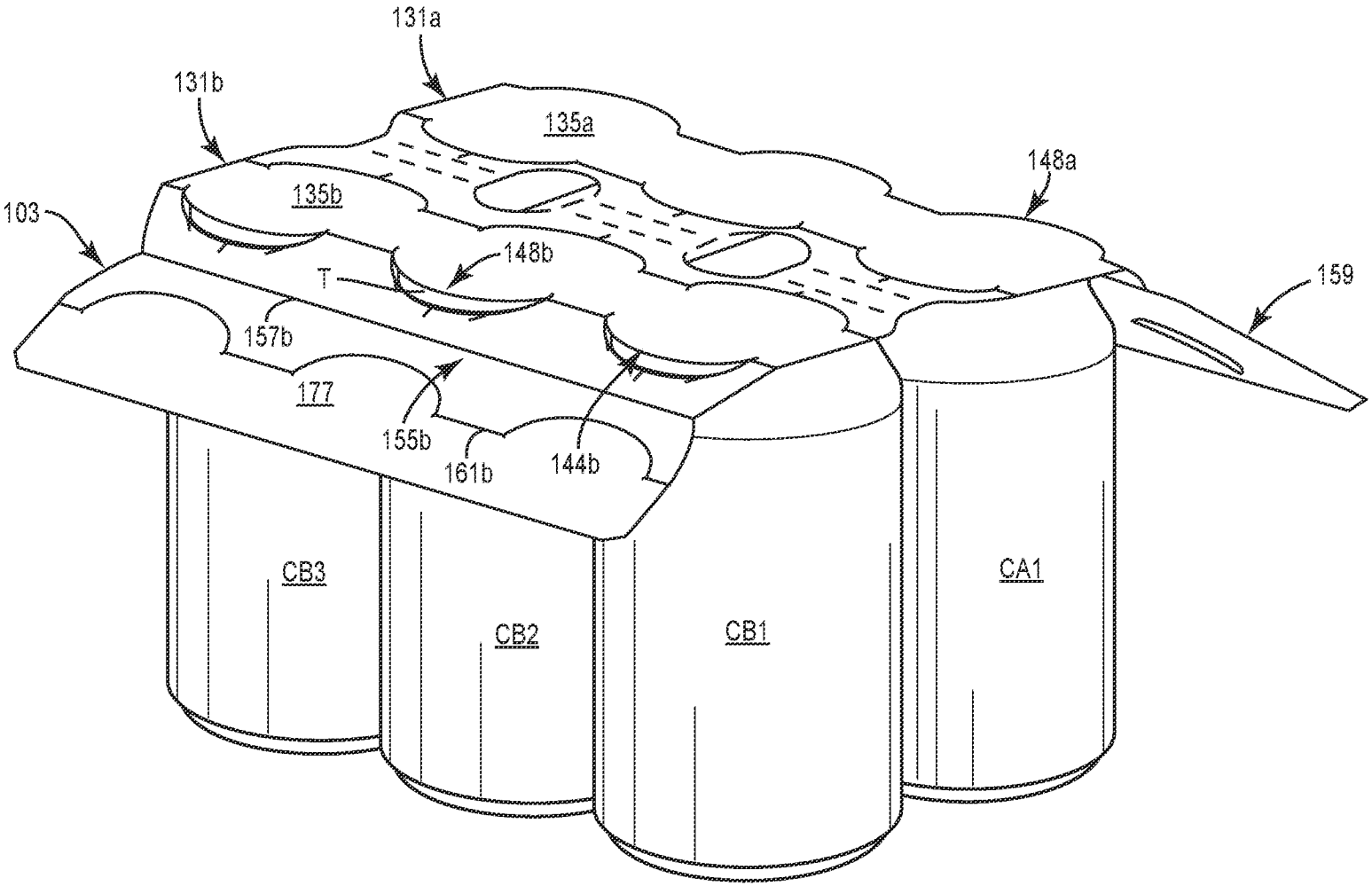
FIG. 2 is a perspective view of a formation of a package and carrier from the blank of FIG. 1 according to the exemplary embodiment.

As shown in FIG. 2, the blank 103 can be inverted such that the exterior surface 101 of the blank 103 can be placed atop the containers CA1, CA2, CA3, CB1, CB2, CB3 such that the container retention portion 135*a* of the front attachment panel 131*a* overlies the containers CA1, CA2, CA3 and such that the container retention portion 135*b* of the back attachment panel 131*b* overlies the containers CB1, CB2, CB3. Further downward positioning of the attachment panels 131*a*, 131*b* over the plurality of containers CA1, CA2, CA3, CB1, CB2, CB3 can activate the respective container retention portions 135*a*, 135*b* to engage respective containers.

For example, as the front attachment panel 131*a* is lowered or urged downwardly onto the containers CA1, CA2, CA3 the container retention portion 135*a* can at least partially separate from the remainder of the front attachment panel 131*a* at the cuts 141*a*. In such an arrangement, upper or top portions T of the respective containers CA1, CA2, CA3 can extend at least partially through respective openings formed by the respective cuts 141*a* such that the container retention tabs 148*a* can sit within recessed portions of the containers CA1, CA2, CA3, e.g., recessed tops of the containers CA1, CA2, CA3 below rolled upper rims thereof.

Such reconfiguration of the corresponding portions of the back attachment panel 131*b* can occur as the back attachment panel 131*b* is lowed or urged downwardly onto the containers CB1, CB2, CB3.

The marginal portions 136*a*, 138*a* of the attachment panel 131*a* can fold at least partially downwardly at the respective fold lines 137*a*, 139*a* in such a configuration, and, similarly, the marginal portions 136*b*, 138*b* of the attachment panel 131*b* can fold at least partially downwardly at the respective fold lines 137*b*, 139*b*. In this regard, the marginal portions 136*a*, 138*a* can be obliquely arranged relative to the attachment portion 135*a* of the attachment panel 131*a* and the marginal portions 136*b*, 138*b* can be obliquely arranged relative to the attachment portion 135*b* of the attachment panel 131*b*. Such movement can cause reconfiguration of the outer marginal portion 138*a* of the front attachment panel 131*a* to reconfigure at the respective cuts 143*a*, 145*a*, 146*a* to engage a rolled rim or other top structure of the respective containers CA1, CA2, CA3.

The back attachment panel 131*b* and corresponding container retention portion 135*b* can engage the containers CB1, CB2, CB3 in a manner similar to that described above with respect to the engagement of the front attachment panel 131*a* and container retention portion 135*a* with respect to the containers CA1, CA2, CA3.

Still referring to FIG. 2, the front side panel 155*a* can be folded upwardly at the fold line 157*a*, for example, to be at an oblique arrangement relative to the attachment portion 135*a* of the attachment panel 131*a*, and the top panel 159 (broadly, "first top panel") can be folded at the fold line 161*a* into at least partial face-to-face contact with at least a portion of the attachment panels 131*a*, 131*b*. Such movement of the top panel 159 can cause the container retention tabs 148*a* to separate from the front side panel 155*a* at the respective cuts 141*a*, and can at least partially overlie the container retention tabs 148*a* associated with the attachment panel 131*a*. In this regard, the rolled rim or other top structure of the respective containers CA1, CA2, CA3 can be at least partially received through the cuts 141*a* along the fold line 161*a* such that the container retention tabs 148*a* extending from the top panel 159 can also sit within recessed upper portions of the containers CA1, CA2, CA3.

Similarly, the back side panel 155*b* can be folded upwardly at the fold line 157*b* into an oblique arrangement with the attachment portion 135*b* of the attachment panel 131*b*, and the attachment flap 177 can be folded at the fold line 161*b* into at least partial face-to-face contact with the top panel 159 and/or the attachment panel 131*b*. Such movement of the attachment flap 177 can cause engagement with the containers CB1, CB2, CB3 in a manner similar to that described above with regard to the engagement of the top panel 159 with the containers CA1, CA2, CA3.

This positioning of the top panel 159 can align the handle openings 163 with the respective handle apertures 130 therebelow to facilitate engagement with the carrier 105/package 110 by a customer or other user. The aforementioned arrangement of the carrier 105 can be maintained with one or more applications of an adhesive such as glue, or, in embodiments, the carrier 105 can be devoid of glue.

Figure 4:
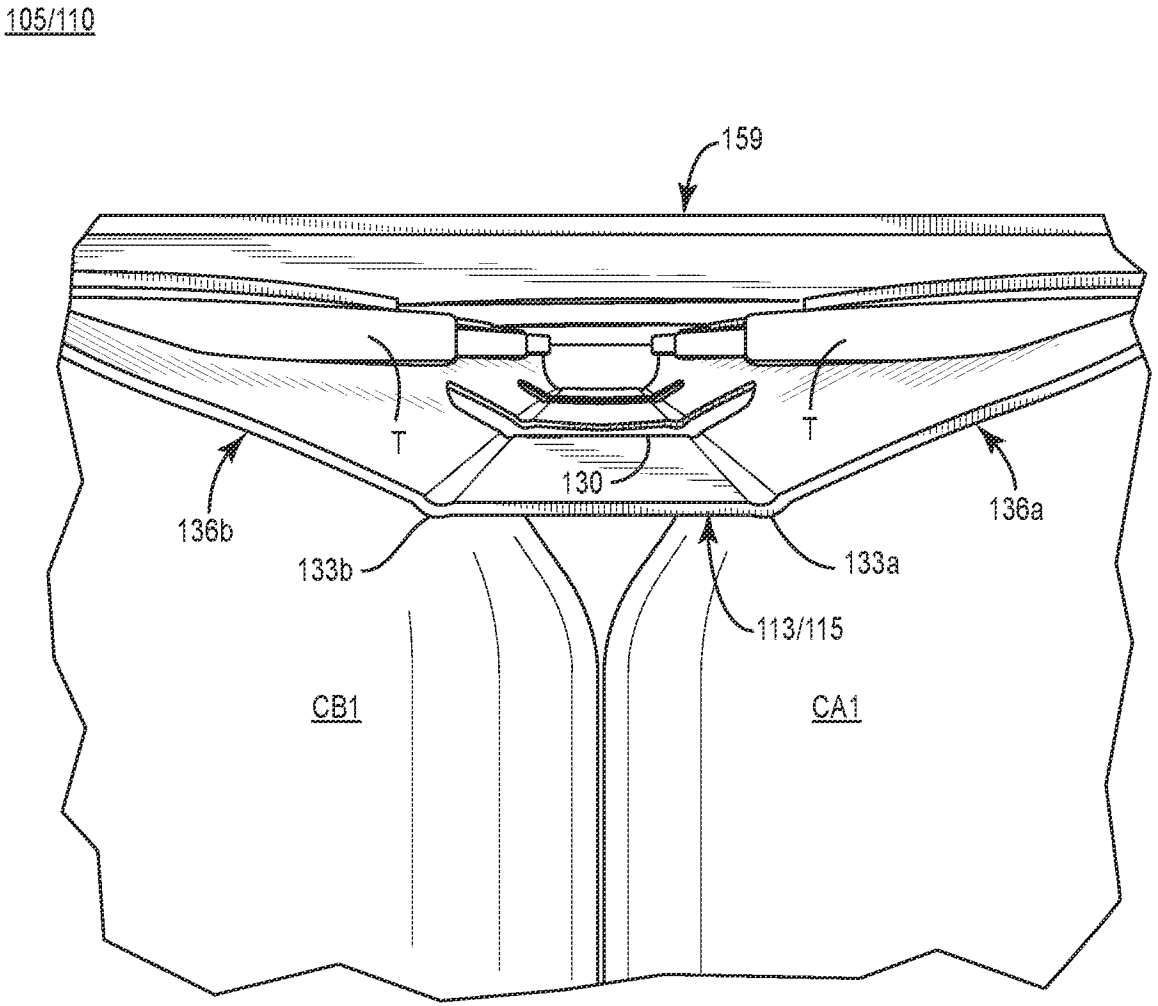
FIG. 4 is an enlarged view of a portion of the package and carrier of FIG. 3.

Accordingly, in the formed carrier 105 as shown in FIGS. 3 and 4, containers can be engaged by the respective attachment panels 131*a*, 131*b* and can extend below the respective container retention portions 135*a*, 135*b* in the assembled carrier 105/package 110. In such an arrangement, the containers CA1, CA2, CA3 extend below the container retention portion 135*a* in the front portion 106 of the carrier 105, and the containers CB1, CB2, CB3 extend below the container retention portion 135*b* in the back portion 108 of the carrier 105, with the top panel 159 and the attachment flap 177 overlying and in at least partial face-to-face contact with respective portions of the respective container retention portions 135*a*, 135*b*.

Furthermore, the positioning of the reinforcement panel 115 extending from the front portion 106 of the carrier 105 to the back portion 108 of the carrier 105 provides reinforcement to the carrier 105 in the course of movement or other loading, e.g., transportation, storage, carrying, incidental to use, etc. In this regard, the arrangement of reinforcement panel 115 spaced below the top panels 159, 177/attachment portions 135*a*, 135*b* and in generally parallel relation thereto provides the carrier 105 with an increased capacity to minimize, inhibit, avoid, prevent, and/or otherwise resist bending, bowing, flexing, buckling, curling, deflection, and/or other deformation.

In one embodiment, the arrangement of the reinforcement panel 115 extending from the obliquely-arranged interior marginal portion 136*a* of the front portion 106 of the carrier 105 to the obliquely-arranged interior marginal portion 136*b* of the back portion 108 of the carrier 105 can provide an arch-like construction that tends to resolve applied forces into compressive stresses outwardly away from the reinforcement panel 115, e.g., so as to favorably distribute stresses along the carrier 105.

Still referring to FIGS. 3 and 4, the carrier 105 can be grasped by inserting a user's fingers through the handle openings 163 and into the handle apertures 130 below to facilitate contact by the user's fingers of the underside of one or more of the reinforcement panel 115, the front attachment panel 131*a*, and the back attachment panel 131*b*. Such engagement of the carrier 105 by the user can cause one or both of the handle reinforcement flaps 165 to fold downwardly at the respective longitudinal fold lines 167, which in turn, can cause further downward folding of the respective handle reinforcement flaps 132 at the respective fold lines 134 to provide one or more additional plies of material between the user's fingers and the underside of the carrier 105, e.g., for comfort, to avoid pinching, etc. and/or to provide a reinforced structure for engagement by the user that is resistant to tearing or other deformation due to carrying stresses. In addition, the lines of weakening 175 in the handle reinforcement flaps 165 can permit at least partial reconfiguration thereof, e.g., to at least partially fold, flex, curl, etc. about a user's fingers to provide additional cushioning and support. In this regard, the handle apertures 130, the handle reinforcement flaps 132, the handle openings 163, and the handle reinforcement flaps 165, in combinations and subcombinations, can form handle features of the carrier 105.

The package 110/carrier 105 described above has a compact structure that can, for example, provide materials savings and waste reduction. Additionally, the positioning of the reinforcement panel 115 between the front portion 106 and the back portion 108 of the carrier 105 results in a robust structure for holding and carrying the containers CA1, CA2, CA3, CB1, CB2, CB3. Further, the exposure of one or more portions of the containers CA1, CA2, CA3, CB1, CB2, CB3 on exterior portions of the carrier 105/package 110 provides a consumer with a clear view of labeling or surface graphics associated with the containers CA1, CA2, CA3, CB1, CB2, CB3 as well as providing convenient access to remove one or more of the containers CA1, CA2, CA3, CB1, CB2, CB3 from the carrier 105/package 110, for example, by withdrawing a respective container through the respective cuts 141*a*, 141*b* to disengage the container from the respective panel 131*a*, 131*b*, 159, 177.

It will be understood that the blanks and carriers described herein can be provided in different configurations without departing from the disclosure. For example, the blanks and carriers described herein can be sized and provided with a corresponding number of features suitable to engage a desired number and configuration of containers.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a front portion comprising a front attachment panel for at least partially receiving a respective container of the plurality of containers, the front attachment panel comprises an attachment portion, an interior marginal portion foldably connected to the attachment portion, and an exterior marginal portion foldably connected to the attachment portion;

a back portion comprising a back attachment panel for at least partially receiving a respective container of the plurality of containers; and a reinforcement portion extending from the front portion to the back portion for reinforcing the carrier, the reinforcement portion comprises a reinforcement panel foldably connected to each of the back attachment panel and the interior marginal portion of the front attachment panel.

2. The carrier of claim 1, wherein the front portion further comprises a front top panel in at least partial face-to-face contact with the front attachment panel, the reinforcement panel being spaced apart from the front top panel.

3. The carrier of claim 1, wherein at least one of the front attachment panel and the back attachment panel comprises a plurality of cuts for at least partially receiving the respective container of the plurality of containers therethrough.

4. The carrier of claim 3, wherein the front portion further comprises a front side panel foldably connected to the front attachment panel and a front top panel foldably connected to the front side panel, the front top panel positioned in at least partial face-to-face contact with the front attachment panel.

5. The carrier of claim 4, wherein the reinforcement panel is positioned in spaced and parallel relation to the attachment portion of the front attachment panel.

6. The carrier of claim 5, wherein each of the interior marginal portion and the exterior marginal portion is obliquely arranged relative to the attachment portion of the front attachment panel.

7. The carrier of claim 6, wherein the front side panel is foldably connected to the exterior marginal portion of the front attachment panel.

8. The carrier of claim 7, wherein the back portion of the carrier further comprises a back side panel foldably connected to the back attachment panel, and a back top panel foldably connected to the back side panel, the back top panel positioned in at least partial face-to-face contact with the back attachment panel.

9. The carrier of claim 8, wherein the carrier further comprises handle features, the handle features comprising at least one upper handle opening formed in the front top panel and aligned over at least one lower handle opening formed in the reinforcement panel.

10. The carrier of claim 9, wherein an upper handle reinforcement flap is foldably connected to the front top panel and positioned extending into the at least one upper handle opening, and a lower handle reinforcement flap is foldably connected to the reinforcement panel and positioned extending into the at least one lower handle opening.

11. A blank for forming a carrier for holding a plurality of containers, the blank comprising:

a front portion comprising a front attachment panel for at least partially receiving a respective container of the plurality of containers, the front attachment panel comprises an attachment portion, an interior marginal portion foldably connected to the attachment portion, and an exterior marginal portion foldably connected to the attachment portion;

a back portion comprising a back attachment panel for at least partially receiving a respective container of the plurality of containers; and a reinforcement portion extending from the front portion to the back portion for reinforcing the carrier formed from the blank, the reinforcement portion comprises a reinforcement panel foldably connected to each of the back attachment panel and the interior marginal portion of the front attachment panel.

12. The blank of claim 11, wherein at least one of the front attachment panel and the back attachment panel comprises a plurality of cuts for at least partially receiving the respective container of the plurality of containers therethrough.

13. The blank of claim 12, wherein the front portion further comprises a front side panel foldably connected to the front attachment panel and a front top panel foldably connected to the front side panel, the front top panel positioned in at least partial face-to-face contact with the front attachment panel.

14. The blank of claim 13, wherein the front side panel is foldably connected to the exterior marginal portion of the front attachment panel.

15. The blank of claim 14, wherein the back portion of the blank further comprises a back side panel foldably connected to the back attachment panel, and a back top panel foldably connected to the back side panel.

16. The blank of claim 15, wherein the blank further comprises handle features, the handle features comprising at least one upper handle opening formed in the front top panel and for being aligned over the at least one lower handle opening formed in the reinforcement panel when the carrier is formed from the blank.

17. The blank of claim 16, wherein an upper handle reinforcement flap is foldably connected to the front top panel and positioned extending into the at least one upper handle opening, and a lower handle reinforcement flap is foldably connected to the reinforcement panel and positioned extending into the at least one lower handle opening.

18. A method of forming a carrier for holding a plurality of containers, the method comprising:

obtaining a blank comprising a front portion, a back portion, and a reinforcement portion extending from the front portion of the blank to the back portion of the blank, the front portion comprising a front attachment panel, the front attachment panel comprises an attachment portion, an interior marginal portion foldably connected to the attachment portion, and an exterior marginal portion foldably connected to the attachment portion, and the back portion comprising a back attachment panel, the reinforcement portion comprising a reinforcement panel, the reinforcement portion comprises a reinforcement panel foldably connected to each of the back attachment panel and the interior marginal portion of the front attachment panel; and positioning the front attachment panel for at least partially receiving a respective container of the plurality of containers to form a front portion of the carrier and positioning the back attachment panel for at least partially receiving a respective container of the plurality of containers to form a back portion of the carrier;

positioning the reinforcement panel extending from the front portion of the carrier to the back portion of the carrier to reinforce the carrier.

19. The method of claim 18, wherein the front portion of the blank further comprises a front top panel and the method further comprises positioning the front top panel in at least partial face-to-face contact with the front attachment panel such that the reinforcement panel is spaced apart from the front top panel.

20. The method of claim 18, wherein at least one of the front attachment panel and the back attachment panel comprises a plurality of cuts for at least partially receiving the respective container of the plurality of containers therethrough.

21. The method of claim 20, wherein the front portion of the blank further comprises a front side panel foldably connected to the front attachment panel and a front top panel foldably connected to the front side panel, and the method further comprises positioning the front top panel in at least partial face-to-face contact with the front attachment panel.

22. The method of claim 21, wherein positioning the reinforcement panel comprises positioning the reinforcement panel in spaced and parallel relation to the attachment portion of the front attachment panel.

23. The method of claim 22, wherein positioning the front attachment panel comprises arranging the interior marginal portion of the front attachment panel and the exterior marginal portion of the front attachment panel in an oblique arrangement relative to the attachment portion of the front attachment panel.

24. The method of claim 23, wherein the back portion of the blank further comprises a back side panel foldably connected to the back attachment panel, and a back top panel foldably connected to the back side panel, and the method further comprises positioning the back top panel in at least partial face-to-face contact with the back attachment panel.

25. The method of claim 24, wherein the blank further comprises handle features, the handle features comprising at least one upper handle opening formed in the front top panel at least one lower handle opening formed in the reinforcement panel, and the method further comprises aligning the at least one upper handle opening over the at least one lower handle opening.

26. The method of claim 25, wherein an upper handle reinforcement flap is foldably connected to the front top panel and positioned extending into the at least one upper handle opening, and a lower handle reinforcement flap is foldably connected to the reinforcement panel and positioned extending into the at least one lower handle opening.

27. A package, the package comprising:

a plurality of containers; and a carrier, the carrier comprising:

a front portion comprising a front attachment panel at least partially receiving a respective container of the plurality of containers, the front attachment panel comprises an attachment portion, an interior marginal portion foldably connected to the attachment portion, and an exterior marginal portion foldably connected to the attachment portion;

a back portion comprising a back attachment panel at least partially receiving a respective container of the plurality of containers; and a reinforcement portion extending from the front portion to the back portion for reinforcing the package, the reinforcement portion comprises a reinforcement panel foldably connected to each of the back attachment panel and the interior marginal portion of the front attachment panel.

28. The package of claim 27, wherein the front portion further comprises a front top panel in at least partial face-to-face contact with the front attachment panel, the reinforcement panel being spaced apart from the front top panel.

29. The package of claim 27, wherein at least one of the front attachment panel and the back attachment panel comprises a plurality of cuts at least partially receiving the respective container of the plurality of containers therethrough.

30. The package of claim 29, wherein the front portion further comprises a front side panel foldably connected to the front attachment panel and a front top panel foldably connected to the front side panel, the front top panel positioned in at least partial face-to-face contact with the front attachment panel.

31. The package of claim 30, wherein the reinforcement panel is positioned in spaced and parallel relation to the attachment portion of the front attachment panel.

32. The package of claim 31, wherein each of the interior marginal portion and the exterior marginal portion is obliquely arranged relative to the attachment portion of the front attachment panel.

33. The package of claim 32, wherein the front side panel is foldably connected to the exterior marginal portion of the front attachment panel.

34. The package of claim 33, wherein the back portion of the carrier further comprises a back side panel foldably connected to the back attachment panel, and a back top panel foldably connected to the back side panel, the back top panel positioned in at least partial face-to-face contact with the back attachment panel.

35. The package of claim 34, wherein the carrier further comprises handle features, the handle features comprising at least one upper handle opening formed in the front top panel and aligned over at least one lower handle opening formed in the reinforcement panel.

36. The package of claim 35, wherein an upper handle reinforcement flap is foldably connected to the front top panel and positioned extending into the at least one upper handle opening, and a lower handle reinforcement flap is foldably connected to the reinforcement panel and positioned extending into the at least one lower handle opening.

* * * * *